US011190884B2

(12) United States Patent
Jung et al.

(10) Patent No.: US 11,190,884 B2
(45) Date of Patent: Nov. 30, 2021

(54) TERMINAL WITH HEARING AID SETTING, AND METHOD OF SETTING HEARING AID

(71) Applicant: SAMSUNG ELECTRO-MECHANICS CO., LTD., Suwon-si (KR)

(72) Inventors: Dae Kwon Jung, Suwon-si (KR); Yun Tae Lee, Suwon-si (KR); Jung Sun Kwon, Suwon-si (KR); Ho Kwon Yoon, Suwon-si (KR); Bang Chul Ko, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 16/855,343

(22) Filed: Apr. 22, 2020

(65) Prior Publication Data

US 2020/0404432 A1 Dec. 24, 2020

(30) Foreign Application Priority Data

Jun. 20, 2019 (KR) ..... 10-2019-0073394
Nov. 7, 2019 (KR) ..... 10-2019-0141962

(51) Int. Cl.
*H04R 25/00* (2006.01)

(52) U.S. Cl.
CPC ..... *H04R 25/505* (2013.01); *H04R 25/407* (2013.01); *H04R 25/554* (2013.01)

(58) Field of Classification Search
CPC ... H04R 25/505; H04R 25/407; H04R 25/554
USPC ..... 381/312
See application file for complete search history.

(56) References Cited

U.S. PATENT DOCUMENTS 10,102,732 B2 * 10/2018 Gersten ..... G08B 21/10

FOREIGN PATENT DOCUMENTS

KR 10-2005-0119758 A 12/2005
KR 10-2016-0028651 A 3/2016
KR 10-2017-0085874 A 7/2017

* cited by examiner

*Primary Examiner* — Phylesha Dabney
(74) *Attorney, Agent, or Firm* — NSIP Law

(57) ABSTRACT

A terminal may include: a sensor unit including a microphone configured to acquire a surrounding sound, and a position sensor configured to identify a position of the terminal; a processor configured to learn the position of the terminal and the surrounding sound to identify characteristics of a dangerous sound depending on the position of the terminal, and determine a setting value of a hearing aid depending on the identified characteristics of the dangerous sound; and a communicator configured to transmit the setting value to the hearing aid.

16 Claims, 3 Drawing Sheets

TERMINAL WITH HEARING AID SETTING, AND METHOD OF SETTING HEARING AID

CROSS-REFERENCE TO RELATED APPLICATION(S)

This application claims the benefit under 35 U.S.C. § 119(a) of Korean Patent Application Nos. 10-2019-0073394 and 10-2019-0141962 filed on Jun. 20, 2019 and Nov. 7, 2019, respectively, in the Korean Intellectual Property Office, the entire disclosures of which are incorporated herein by reference for all purposes.

BACKGROUND

1. Field

The following description relates to a terminal, for example, a mobile terminal, configured to set a setting value of a hearing aid, and a method of setting the hearing aid.

2. Description of Related Art

A hearing aid is a device configured to amplify or modify a sound in an audio bandwidth that people of normal hearing ability can hear, to allow people having an auditory disorder to sense a sound to the same degree as people of normal hearing ability. In the past, hearing aids simply functioned to amplify external sounds. However, recently, digital hearing aids capable of delivering clearer sound to users under various environments have been developed.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a terminal includes: a sensor unit including a microphone configured to acquire a surrounding sound, and a position sensor configured to identify a position of the terminal; a processor configured to learn the position of the terminal and the surrounding sound to identify characteristics of a dangerous sound depending on the position of the terminal, and determine a setting value of a hearing aid depending on the identified characteristics of the dangerous sound; and a communicator configured to transmit the setting value to the hearing aid.

The processor may be further configured to: use a signal received from a device connected to the terminal to recognize an occurrence of a danger, the surrounding sound being acquired by the microphone at a same time the signal is received; and identify the characteristics of the dangerous sound corresponding to the danger.

The communicator may be configured to receive information on a sound introduced into the hearing aid, from the hearing aid.

The processor may be further configured to: learn the information on the sound introduced into the hearing aid, in response to the occurrence of the danger being recognized; and identify the characteristics of the dangerous sound corresponding to the danger based on the information on the sound introduced into the hearing aid.

The device connected to the terminal may include any one or any combination of any two or more of an electrical outlet monitoring device, a gas valve monitoring device, and a fire alarm sensor.

The processor may be further configured to use a look-up table storing the position of the terminal and the dangerous sound corresponding to the position of the terminal, to identify the characteristics of the dangerous sound.

The processor may be further configured to learn a sound recorded or downloaded by a user of the terminal, to identify the characteristics of the dangerous sound.

The terminal may be a mobile terminal.

In another general aspect, a method of setting a hearing aid includes: using a position sensor in a terminal to identify a position of the terminal; learning, by the terminal, a surrounding sound to identify characteristics of a dangerous sound depending on the position of the terminal; determining, by the terminal, a setting value based on the identified characteristics of the dangerous sound; and transmitting, by the terminal, the setting value to a hearing aid.

The method may further include further include using a microphone in the terminal to collect the surrounding sound.

The method may further include receiving, by the terminal, the surrounding sound from the hearing aid.

The identifying of the characteristics of the dangerous sound may include: using a signal received from a device connected to the terminal to recognize an occurrence of a danger, the surrounding sound being acquired at the same time that the signal is received; and identifying the characteristics of the dangerous sound corresponding to the danger.

The identifying of the characteristics of the dangerous sound may include identifying the characteristics of the dangerous sound by using a look-up table storing the position of the terminal and the dangerous sound corresponding to the position of the terminal.

The identifying the characteristics of the dangerous sound may include identifying the characteristics of the dangerous sound by learning a sound recorded or downloaded by a user of the terminal.

The method may further include generating a warning sound by the hearing aid, in response to a sound corresponding to the setting value being introduced into the hearing aid.

The method may further include generating a warning sound by the hearing aid, in response to a sound corresponding to the setting value gradually increasing in the hearing aid.

The terminal may be a mobile terminal.

In another general aspect, a non-transitory computer-readable storage medium stores instructions that, when executed by a processor, cause the processor to perform the method described above.

Other features and aspects will be apparent from the following detailed description, the drawings, and the claims.

Figure 1:
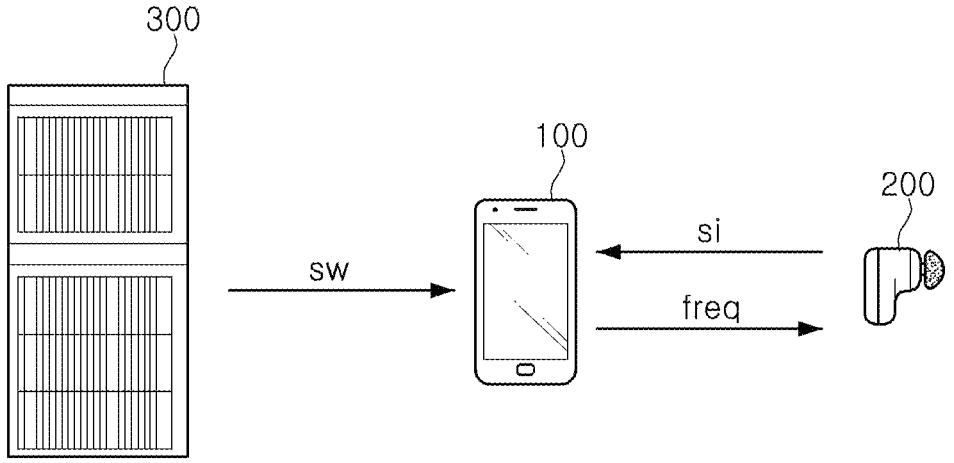
FIG. 1 is a view schematically illustrating a system for performing a method of setting a hearing aid, according to an embodiment.

Throughout the drawings and the detailed description, the same drawing reference numerals refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known after an understanding of the disclosure of this application may be omitted for increased clarity and conciseness.

The features described herein may be embodied in different forms and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

The terminology used herein is for describing various examples only and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

The features of the examples described herein may be combined in various ways as will be apparent after an understanding of the disclosure of this application. Further, although the examples described herein have a variety of configurations, other configurations are possible as will be apparent after an understanding of the disclosure of this application.

FIG. 1 is a view schematically illustrating a system for performing a method of setting a hearing aid, according to an embodiment. Referring to FIG. 1, the system may include a terminal 100, a hearing aid 200, and a server 300. The terminal 100 is, for example, a mobile terminal, and will be referred to as a mobile terminal hereinafter as a non-limiting example.

The mobile terminal 100 may output, to the hearing aid 200, a setting value (freq) for determining a frequency characteristic, or the like, of the hearing aid 200. The mobile terminal 100 may output the setting value (freq) based on an acoustic signal sensed by the mobile terminal 100, information on surrounding conditions sensed by the mobile terminal 100, acoustic information (si) received from the hearing aid 200, or the like. An operation of the mobile terminal 100 may be performed by executing at least one application. In addition, the mobile terminal 100 may download the at least one application from the server 300.

The hearing aid 200 may amplify and output a sound introduced from an external source. In this case, operating characteristics (e.g., gain for each frequency band or the like) of the hearing aid 200 may be determined by the setting value (freq).

The server 300 may store at least one application for the mobile terminal 100 to perform operations to be described below. The server 300 may transmit at least one application (sw) to the mobile terminal 100, according to a request of the mobile terminal 100.

Figure 2:
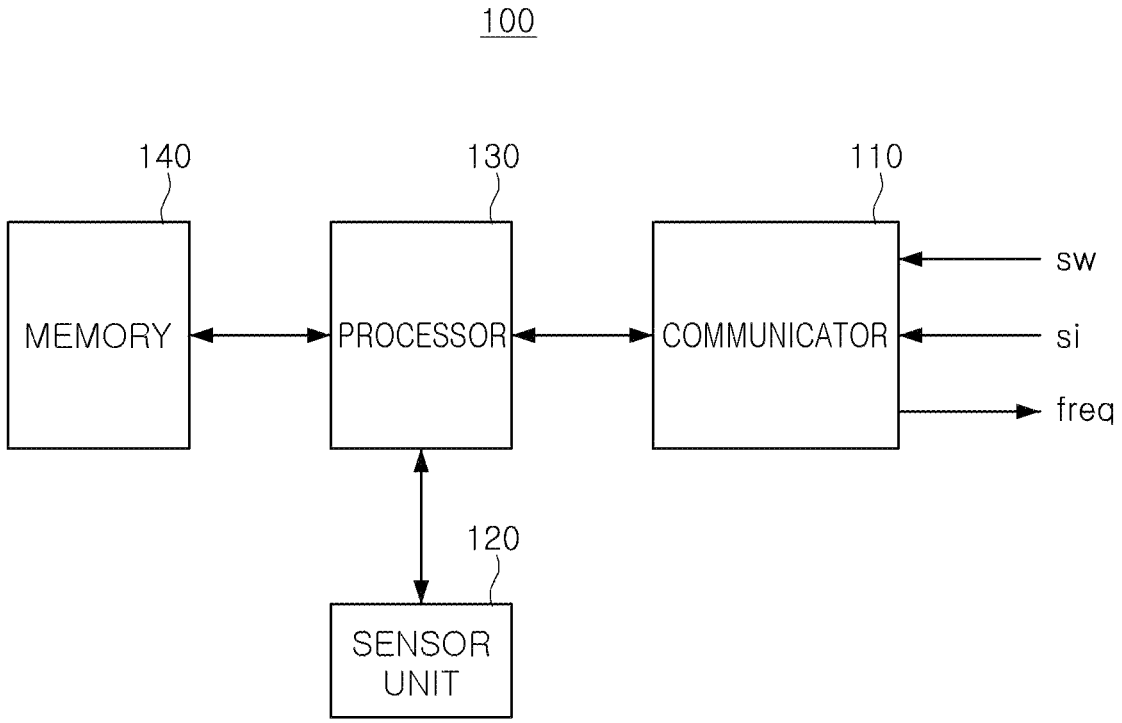
FIG. 2 is a block diagram schematically illustrating a configuration of a mobile terminal, according to an embodiment.

FIG. 2 is a block diagram schematically illustrating a configuration of the mobile terminal 100, according to an embodiment. The mobile terminal 100 may include, for example, a communicator 110, a sensor unit 120, a processor 130, and a memory 140.

The communicator 110 may include a plurality of communications modules for transmitting and receiving data in different ways. The communicator 110 may download at least one application (sw) from the server 300 (FIG. 1). In addition, the communicator 110 may receive information (si) about an acoustic signal collected by the hearing aid 200 (FIG. 1) from the hearing aid 200. In addition, the communicator 110 may transmit a setting value (freq) of the hearing aid to the hearing aid 200 of FIG. 1. The setting value (freq) of the hearing aid 200 may be a value for determining operating characteristics of the hearing aid 200, and may be, for example, a gain value for each frequency band among audible frequency bands. Alternatively, the setting value (freq) of the hearing aid may be a frequency characteristic for a specific sound.

The sensor unit 120 may include, for example, a microphone configured to acquire a surrounding sound, a position sensor configured to identify a position of the mobile terminal, and various sensors configured to sense surrounding environments. The position sensor may include a global positioning system (GPS) receiver or the like. The position sensor may use a position of an access point (AP) connected through a Wi-Fi communications network, a connected Bluetooth device, or the like, to identify a position of the mobile terminal 100. Alternatively, the position sensor may use a personal schedule stored in the mobile terminal 100 to identify a position of the mobile terminal 100.

The processor 130 may control an overall operation of the mobile terminal 100. The processor 130 may store the application received from the server in the memory 140, and may load and execute the application stored in the memory 140, as needed.

The processor 130 may be configured to identify a surrounding environment of a user (e.g., a position of the user, a current situation, or the like), based on the acoustic signal input by the microphone of the sensor unit 120 and the position of the mobile terminal input by the position sensor of the sensor unit 120, and may be configured to identify characteristics of a surrounding noise depending on the surrounding environment of the user. The characteristics of the surrounding noise may be a frequency band of the surrounding noise. For example, the processor 130 may identify a frequency band of a surrounding noise corresponding to the surrounding environment of the user through a learning operation. For example, the processor 130 may identify a frequency band of a surrounding noise that occurs frequently when the user is at home, a frequency band of a surrounding noise that occurs frequently when the user commutes to work, or the like.

In addition, the processor 130 may identify characteristics of a dangerous sound in a corresponding environment. For example, the processor 130 may be configured to use a signal received from devices connected to the mobile terminal (e.g., a smartphone) to recognize occurrence of a specific danger, and learn a sound input by the mobile terminal or the hearing aid at the same time, and may be configured to identify the characteristics of the dangerous sound corresponding to the specific danger, based on the sound input by the by the mobile terminal or the hearing aid. The devices connected to the mobile terminal may be devices connected to the mobile terminal through a local area network such as Bluetooth or Wi-Fi. In addition, the devices connected with the mobile terminal may be an internet of things (IoT) device (e.g., an electrical outlet monitoring device, a gas valve monitoring device, or a fire alarm sensor) in a specific place (e.g., home). Alternatively, the processor 130 may be configured to use the position sensor included in the mobile terminal to identify a position of the user, and may be configured to use a look-up table to identify the characteristics of the dangerous sound at a corresponding position. For example, when the user is at home, a sound of boiling water or a fire alarm may be identified as the dangerous sound. When the user is driving, a sound of a car horn, a siren, a warning sound coming from a train crossing, or the like, may be identified as the dangerous sound. Alternatively, the processor 130 may be configured to learn a sound directly input by the user to identify the characteristics of the dangerous sound. For example, the processor 130 may be configured to learn a sound directly recorded or downloaded through the Internet by the user, to identify the characteristics of the dangerous sound. Alternatively, the processor 130 may be configured to determine the following recognition as the dangerous sound, when a certain wording or a yell (e.g., "fire!", "thief!", "dangerous!", "please help me", "please save me", "avoid ~," or the like), a scream, or the like is recognized through acoustic translation.

In addition, the processor 130 may be configured to determine a setting value of the hearing aid based on the identified surrounding environment of the user, and determine a dangerous sound depending on the environment. The setting value of the hearing aid may be information of frequency band for the dangerous sound or a gain value for each frequency band.

The processor 130 may include an application processor and a neural processing unit (NPU).

The processor 130 may be configured to perform the above-described operations through a deep learning operation. The deep learning operation, which is a branch of a machine learning process, may be an artificial intelligence technology that allows machines to learn by themselves and infer conclusions without teaching conditions by a human. According to an embodiment, the deep learning operation may be used to determine a setting value of the hearing aid, to effectively notify the user of a dangerous situation. In addition, according to an embodiment, the deep learning operation may be performed using an NPU mounted on the mobile terminal 100 (for example, a smartphone). In addition, according to an embodiment, when a variety of sensors and wireless communications technology mounted on the mobile terminal 100 are used, a position and a situation of the user of the hearing aid may be recognized. In addition, according to an embodiment, when a noise depending on the position and situation of the user is learned using the deep learning operation, an operation of cancelling the noise may be performed more effectively and in a more user-friendly manner than a conventional noise canceling process, to recognize the dangerous situation.

The memory 140 may store at least one application. In addition, the memory 140 may store various data that may be a basis for the learning operation that the processor 130 performs.

Figure 3:
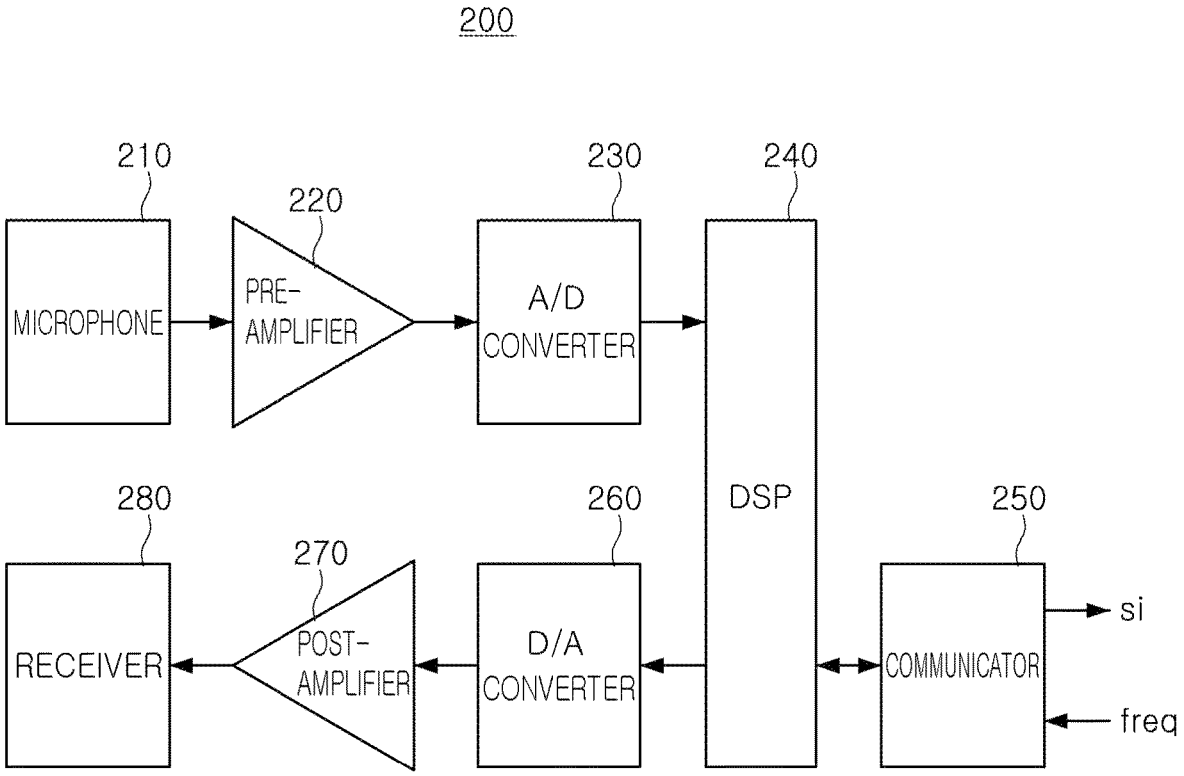
FIG. 3 is a block diagram schematically illustrating a configuration of a hearing aid, according to an embodiment.

FIG. 3 is a block diagram schematically illustrating a configuration of the hearing aid 200, according to an embodiment. The hearing aid 200 may include, for example, a microphone 210, a pre-amplifier 220, an analog-to-digital (A/D) converter 230, a digital signal processor (DSP) 240, a communicator 250, a digital-to-analog (D/A) converter 260, a post-amplifier 270, and a receiver 280.

The microphone 210 may receive an analog sound signal (for example, acoustic signal or the like) externally, and may transmit the analog sound signal to the pre-amplifier 220.

The pre-amplifier 220 may amplify the analog sound signal received from the microphone 210 to a predetermined magnitude.

The A/D converter 230 may receive the amplified analog sound signal output from the pre-amplifier 220, and may convert the amplified analog sound signal into a digital sound signal.

The DSP 240 may receive the digital sound signal, use a signal processing algorithm to process the digital sound signal, and output the processed digital sound signal to the D/A converter 260. Operating characteristics of the signal processing algorithm may be adjusted by the setting value (freq). For example, a gain value may be changed for each frequency band in the signal processing algorithm, depending on the setting value (freq). In addition, when a dangerous signal is input into the microphone 210 of the hearing aid 200, the DSP 240 may inform a user of occurrence of a danger by the receiver 280. For example, when a signal of a frequency band indicated by the setting value (freq) is input to the microphone 210, the DSP 240 may transmit the digital sound signal to the D/A converter 260 in an appropriate manner such that a warning sound may be generated by the receiver 280.

The communicator 250 may receive the setting value (freq) from a mobile terminal 100. In addition, the communicator 250 may transmit the acoustic information (si) about a sound input to the hearing aid 200 to the mobile terminal 100.

The D/A converter 260 may convert the received digital sound signal into an analog sound signal.

The post-amplifier 270 may receive the converted analog sound signal from the D/A converter 260, and may amplify the converted analog sound signal to a predetermined magnitude.

The receiver 280 may receive the amplified analog sound signal from the post-amplifier 270, and may provide the amplified analog sound signal to the user wearing the hearing aid 200.

Figure 4:
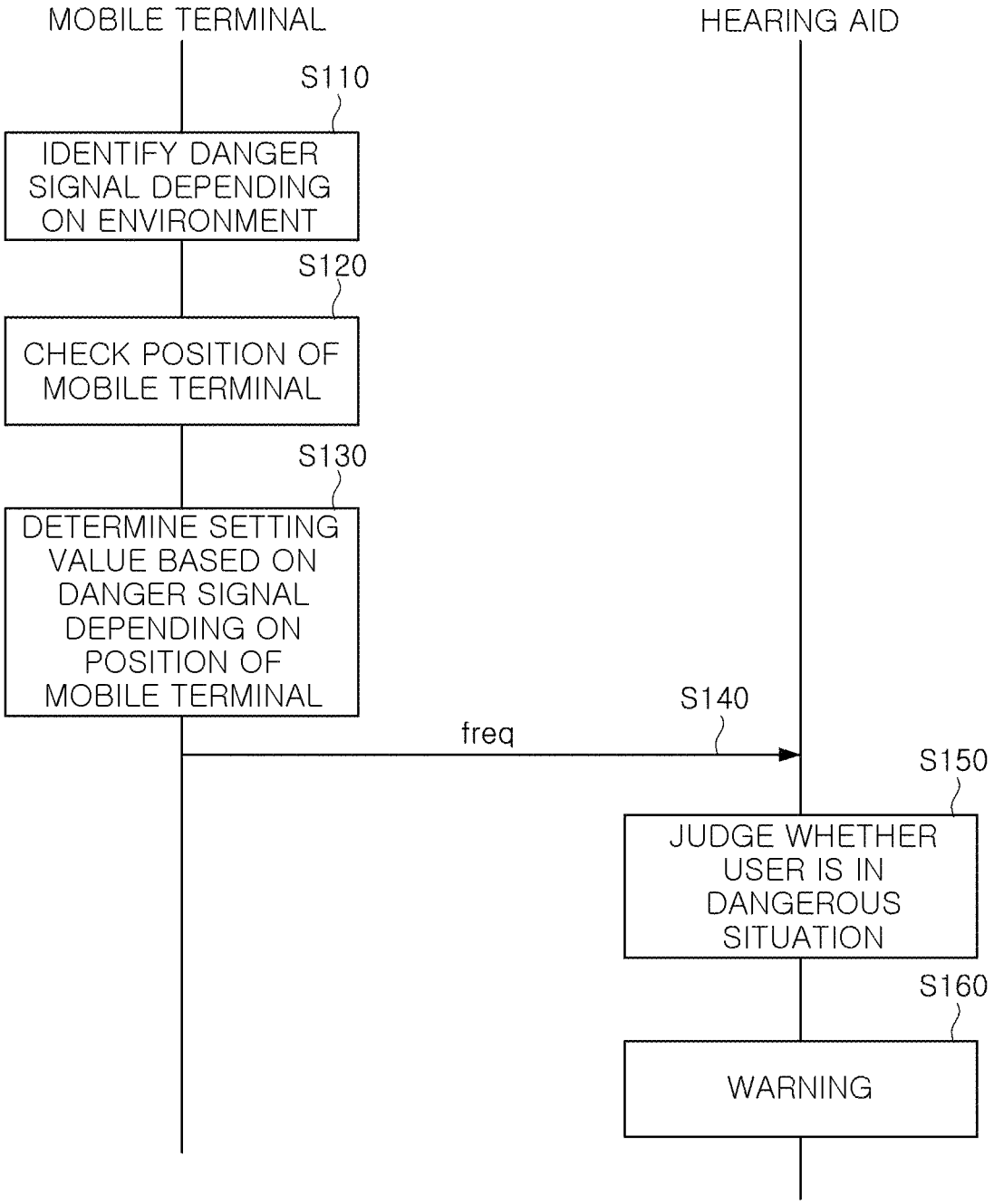
FIG. 4 is a view illustrating a method of setting a hearing aid, according to an embodiment.

FIG. 4 is a view illustrating a method of setting a hearing aid, according to an embodiment.

First, operation S110, a mobile terminal may identify a danger signal depending on an environment. For example, the mobile terminal may be configured to use a signal received from a device connected to the mobile terminal to recognize occurrence of a specific danger, and learn a sound input by the mobile terminal or a hearing aid at the same time, and may be configured to identify characteristics of a dangerous sound corresponding to the specific danger. Alternatively, the mobile terminal may learn a sound input by a user to identify characteristics of a dangerous sound.

Next, in operation S120, the mobile terminal may check a position of the mobile terminal. For example, the mobile terminal may be configured to use a position sensor included in the mobile terminal to identify a position of the user. Operation S120 may be omitted, depending on an example.

Next, in operation S130, the mobile terminal may determine a setting value (freq) based on the danger signal depending on the position of the mobile terminal. For example, the mobile terminal may be configured to use the position of the mobile terminal identified in operation S120 a look-up table, and the like, to identify which sound is the dangerous sound at a corresponding position, and may be configured to determine the frequency characteristics of the dangerous sound as the setting value (freq).

In some cases, the mobile terminal may determine the setting value (freq), regardless of the position of the mobile terminal. For example, frequency characteristics of sounds that the user designates as the dangerous sound may be regarded as the setting value (freq), regardless of the position of the mobile terminal.

Next, the mobile terminal may transmit the setting value (freq) to the hearing aid in operation S140.

Next, in operation S150, the hearing aid may determine whether the user is in a dangerous situation, based on the setting value (freq). For example, when the dangerous sound specified by the setting value (freq) is input, the hearing aid may determine that the user is in the dangerous situation. Alternatively, the hearing aid may determine that the user is in a dangerous situation when the dangerous sound specified by the setting value (freq) gradually increases.

Next, when it is determined, as a result of operation S150, that the user is in a dangerous situation, the hearing aid may warn the user in an appropriate manner in operation S160. For example, the hearing aid may generate a warning sound. For example, the hearing aid may constantly generate a warning sound.

In FIG. 4, each of the operations performed in the mobile terminal (i.e., operations S110 to S140) may be performed by the mobile terminal 100 executing a specific application. The mobile terminal 100 may download the specific application from the server 300.

According to an embodiment, the mobile terminal 100 (e.g., a smartphone or wearable device) may use a sensor of the mobile terminal 100 (e.g., a gyro sensor, an acceleration sensor, a GPS, an illuminance sensor, or the like) and/or other input device of the mobile terminal 100 (e.g., a microphone, a camera, or the like), a wireless communications device (e.g., Wi-Fi, a B/T, a cellular device, or the like), or the like, to identify a current position and surrounding conditions of the user of the hearing aid 200, and may use the processor 130 of the mobile terminal 100 (for example, an NPU) to perform a learning operation (e.g., a deep learning operation) about noise sounds. The mobile terminal 100 may continuously learn noise sounds (e.g., noises and horn sounds from vehicles when the user is near a driveway, motorcycle sounds, or the like) and may transmit a setting value to the hearing aid in an appropriate manner, depending on the results of the learning. As a result, the hearing aid may effectively remove the noise signals learned by inference.

According to an embodiment, with respect to a sound, among noises, that may indicate a dangerous situation in which the user may be threatened (for example, sounds originating from an engine of an automobile, a horn, a train, a motorcycle, or the like), it may be determined whether the sound falls within a dangerous situation, by using artificial intelligence. When it is determined that the sound is in the dangerous situation, a warning sound may be sent through the hearing aid 200 to the user, to warn the user of the dangerous situation and enable the user to evacuate the location of the dangerous situation.

Function values for the situation and sound of the dangerous factors learned by the deep learning operation may be stored and updated in a cloud or the mobile terminal 100, and may be performed continuously when the hearing aid 200 is replaced by a new hearing aid.

According to embodiments disclosed herein, a hearing aid may be set by a mobile terminal to warn a user of the hearing aid of a danger in a more appropriate manner.

The communicator 110, the communicator 250, the sensor unit 120, the processor 130, the memory 140, the server 300, the processor, the A/D converter 230, the DSP 240, the D/A converter 260, the receiver 280, the processors, the memories, and other components and devices in FIGS. 1 to 4 that perform the operations described in this application are implemented by hardware components configured to perform the operations described in this application that are performed by the hardware components. Examples of hardware components that may be used to perform the operations described in this application where appropriate include controllers, sensors, generators, drivers, memories, comparators, arithmetic logic units, adders, subtractors, multipliers, dividers, integrators, and any other electronic components configured to perform the operations described in this application. In other examples, one or more of the hardware components that perform the operations described in this application are implemented by computing hardware, for example, by one or more processors or computers. A processor or computer may be implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices that is configured to respond to and execute instructions in a defined manner to achieve a desired result. In one example, a processor or computer includes, or is connected to, one or more memories storing instructions or software that are executed by the processor or computer.

Hardware components implemented by a processor or computer may execute instructions or software, such as an operating system (OS) and one or more software applications that run on the OS, to perform the operations described in this application. The hardware components may also access, manipulate, process, create, and store data in response to execution of the instructions or software. For simplicity, the singular term "processor" or "computer" may be used in the description of the examples described in this application, but in other examples multiple processors or computers may be used, or a processor or computer may include multiple processing elements, or multiple types of processing elements, or both. For example, a single hardware component or two or more hardware components may be implemented by a single processor, or two or more processors, or a processor and a controller. One or more hardware components may be implemented by one or more processors, or a processor and a controller, and one or more other hardware components may be implemented by one or more other processors, or another processor and another controller. One or more processors, or a processor and a controller, may implement a single hardware component, or two or more hardware components. A hardware component may have any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

The methods illustrated in FIGS. 1 to 4 that perform the operations described in this application are performed by computing hardware, for example, by one or more processors or computers, implemented as described above executing instructions or software to perform the operations described in this application that are performed by the methods. For example, a single operation or two or more operations may be performed by a single processor, or two or more processors, or a processor and a controller. One or more operations may be performed by one or more processors, or a processor and a controller, and one or more other operations may be performed by one or more other processors, or another processor and another controller. One or more processors, or a processor and a controller, may perform a single operation, or two or more operations.

Instructions or software to control computing hardware, for example, one or more processors or computers, to implement the hardware components and perform the methods as described above may be written as computer programs, code segments, instructions or any combination thereof, for individually or collectively instructing or configuring the one or more processors or computers to operate as a machine or special-purpose computer to perform the operations that are performed by the hardware components and the methods as described above. In one example, the instructions or software include machine code that is directly executed by the one or more processors or computers, such as machine code produced by a compiler. In another example, the instructions or software includes higher-level code that is executed by the one or more processors or computer using an interpreter. The instructions or software may be written using any programming language based on the block diagrams and the flow charts illustrated in the drawings and the corresponding descriptions in the specification, which disclose algorithms for performing the operations that are performed by the hardware components and the methods as described above.

The instructions or software to control computing hardware, for example, one or more processors or computers, to implement the hardware components and perform the methods as described above, and any associated data, data files, and data structures, may be recorded, stored, or fixed in or on one or more non-transitory computer-readable storage media. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, and any other device that is configured to store the instructions or software and any associated data, data files, and data structures in a non-transitory manner and provide the instructions or software and any associated data, data files, and data structures to one or more processors or computers so that the one or more processors or computers can execute the instructions. In one example, the instructions or software and any associated data, data files, and data structures are distributed over network-coupled computer systems so that the instructions and software and any associated data, data files, and data structures are stored, accessed, and executed in a distributed fashion by the one or more processors or computers.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A terminal, comprising:

a sensor unit comprising a microphone configured to acquire a surrounding sound, and a position sensor configured to identify a position of the terminal;

a processor configured to learn the position of the terminal and the surrounding sound to identify characteristics of a dangerous sound depending on the position of the terminal, and determine a setting value of a hearing aid depending on the identified characteristics of the dangerous sound; and a communicator configured to transmit the setting value to the hearing aid, wherein the processor is further configured to learn a sound recorded or downloaded by a user of the terminal, to identify the characteristics of the dangerous sound.

2. The terminal according to claim 1, wherein the processor is further configured to:

use a signal received from a device connected to the terminal to recognize an occurrence of a danger, the surrounding sound being acquired by the microphone at a same time the signal is received; and identify the characteristics of the dangerous sound corresponding to the danger.

3. The terminal according to claim 2, wherein the communicator is configured to receive information on a sound introduced into the hearing aid, from the hearing aid.

4. The terminal according to claim 3, wherein the processor is further configured to:

learn the information on the sound introduced into the hearing aid, in response to the occurrence of the danger being recognized; and identify the characteristics of the dangerous sound corresponding to the danger based on the information on the sound introduced into the hearing aid.

5. The terminal according to claim 2, wherein the device connected to the terminal comprises any one or any combination of any two or more of an electrical outlet monitoring device, a gas valve monitoring device, and a fire alarm sensor.

6. The terminal according to claim 1, wherein the processor is further configured to use a look-up table storing the position of the terminal and the dangerous sound corresponding to the position of the terminal, to identify the characteristics of the dangerous sound.

7. The terminal according to claim 1, wherein the terminal is a mobile terminal.

8. A method of setting a hearing aid, comprising:

using a position sensor in a terminal to identify a position of the terminal;

learning, by the terminal, a surrounding sound to identify characteristics of a dangerous sound depending on the position of the terminal;

determining, by the terminal, a setting value based on the identified characteristics of the dangerous sound; and transmitting, by the terminal, the setting value to a hearing aid, wherein the identifying of the characteristics of the dangerous sound comprises identifying the characteristics of the dangerous sound by learning a sound recorded or downloaded by a user of the terminal.

9. The method according to claim 8, further comprising using a microphone in the terminal to collect the surrounding sound.

10. The method according to claim 8, further comprising receiving, by the terminal, the surrounding sound from the hearing aid.

11. The method according to claim 8, wherein the identifying of the characteristics of the dangerous sound comprises:

using a signal received from a device connected to the terminal to recognize an occurrence of a danger, the surrounding sound being acquired at the same time that the signal is received; and identifying the characteristics of the dangerous sound corresponding to the danger.

12. The method according to claim 8, wherein the identifying of the characteristics of the dangerous sound comprises identifying the characteristics of the dangerous sound by using a look-up table storing the position of the terminal and the dangerous sound corresponding to the position of the terminal.

13. The method according to claim 8, further comprising generating a warning sound by the hearing aid, in response to a sound corresponding to the setting value being introduced into the hearing aid.

14. The method according to claim 8, further comprising generating a warning sound by the hearing aid, in response to a sound corresponding to the setting value gradually increasing in the hearing aid.

15. The method of claim 8, wherein the terminal is a mobile terminal.

16. A non-transitory computer-readable storage medium storing instructions that, when executed by a processor, cause the processor to perform the method of claim 8.

* * * * *